United States Patent [19]

Bowyer

[11] 4,281,858

[45] Aug. 4, 1981

[54] SELECTIVELY BRIDGED EXPANSION JOINT

[75] Inventor: Michael L. Bowyer, Aberdeen, Scotland

[73] Assignee: Baker International Corporation, Orange, Calif.

[21] Appl. No.: 83,728

[22] Filed: Oct. 10, 1979

[51] Int. Cl.[3] ..... F16L 35/00

[52] U.S. Cl. ..... 285/39; 285/3; 285/85; 285/302; 285/317; 285/322; 285/DIG. 23; 166/242

[58] Field of Search ..... 285/302, 298, 3, 4, 285/23, DIG. 23, 39, 85, 86, 370, 397, 308, 313, 317, 318, 319, 320, 322; 166/242; 175/321

[56] References Cited

U.S. PATENT DOCUMENTS

| | | | |
|---|---|---|---|
| 2,712,854 | 7/1955 | Creighton | 285/302 X |
| 4,040,649 | 8/1977 | Blackwell | 285/3 |
| 4,073,511 | 2/1978 | Haas et al. | 285/3 |
| 4,074,912 | 2/1978 | Bilderbeck | 285/39 |
| 4,161,216 | 7/1979 | Amancharia | 285/DIG. 23 |
| 4,161,984 | 7/1979 | Watkins | 285/315 X |

*Primary Examiner*—Dave W. Arola
*Attorney, Agent, or Firm*—William C. Norvell, Jr.

[57] ABSTRACT

This invention relates to a selectively telescopable joint carryable in a tubular conduit having upper and lower conduit members which are extendable within a subterranean oil or gas well. The apparatus comprises an outer cylindrical housing with an inner cylindrical body carried therein. One of the housing and the body is connectable to the upper member while the other of the housing and the body is connectable to the lower member. Seal means are carried on one of the housing and the body and are slidable along the other of same to prevent fluid communication during telescopic motion. Engagement profiles are defined on each of the housing and the body. A bridging member is extendable within the joint and between the housing and the body. Engaging means, such as a collet, are carried on the bridging member and are extendably and selectively secured within the profiles whereby the housing and the body are in relative locked position. Means for urging and removing the engaging means out of the engagement profiles are provided whereby the housing and the body may be selectively telescoped relative to one another.

7 Claims, 11 Drawing Figures

SELECTIVELY BRIDGED EXPANSION JOINT

BACKGROUND OF THE INVENTION (1) Field of the Invention

The invention relates to an expansion joint for use on a tubular conduit insertable within a subterranean well, the expansion joint being initially bridged to prevent normal expansion.

(2) Description of the Prior Art

During the completion of a subterranean oil or gas well, expansion and contraction of completion and other tubing conduits and component parts may be expected as a result of thermal expansion and contraction factors, as well as varying pressure. Such physical parameters will cause expansion and/or contraction of the tubular conduit, thus necessitating the incorporation on the length of conduit of an expansion joint. Typically, such expansion joint is telescoping in nature to compensate for expansion and contraction factors within the well.

Oftentimes, however, it will be desirable to carry such an expansion joint on the tubing conduit, but it will be undesirable for such expansion joint to be placed in expanded mode, during the setting of packers, bridge plugs, and other remedial and related tools in the well. The present invention affords such means by providing a selectively bridged expansion joint which is run into the well in "bridged" position, whereby the apparatus will not expand or contract. When it is desirable for the expansion feature of the apparatus to be utilized, the bridge is removed, and the apparatus may telescope, expandingly or contractingly, when desired.

SUMMARY OF THE INVENTION

The present invention is directed toward a selectively telescoping joint which is carryable on a tubular conduit which has upper and lower conduit members which are extendable within a subterranean well. The telescoping joint comprises an outer cylindrical housing with an inner cylindrical body carried interior of the cylindrical housing. One of the housing and the body are connectable to the upper member while the other of the housing and the body are connectable to the lower member. Seal means are carried on one of the housing and the body and are slidable along the other of the housing and the body to prevent fluid communication therebetween. Engagement profiles are defined on each of the housing and the body. A bridging member is extendable within the joint and between the housing and the body. Engaging means on the bridging member are extendably and selectively secured within the profiles whereby the housing and the body are in relative locked position. Means are provided for urging and removing the engaging means out of the engagement profiles whereby the housing and the body may be selectively telescoped in expanding and contracting directions to function as a conventional telescopic joint thereafter.

DESCRIPTION OF THE PREFERRED EMBODIMENT

Figure 1A:
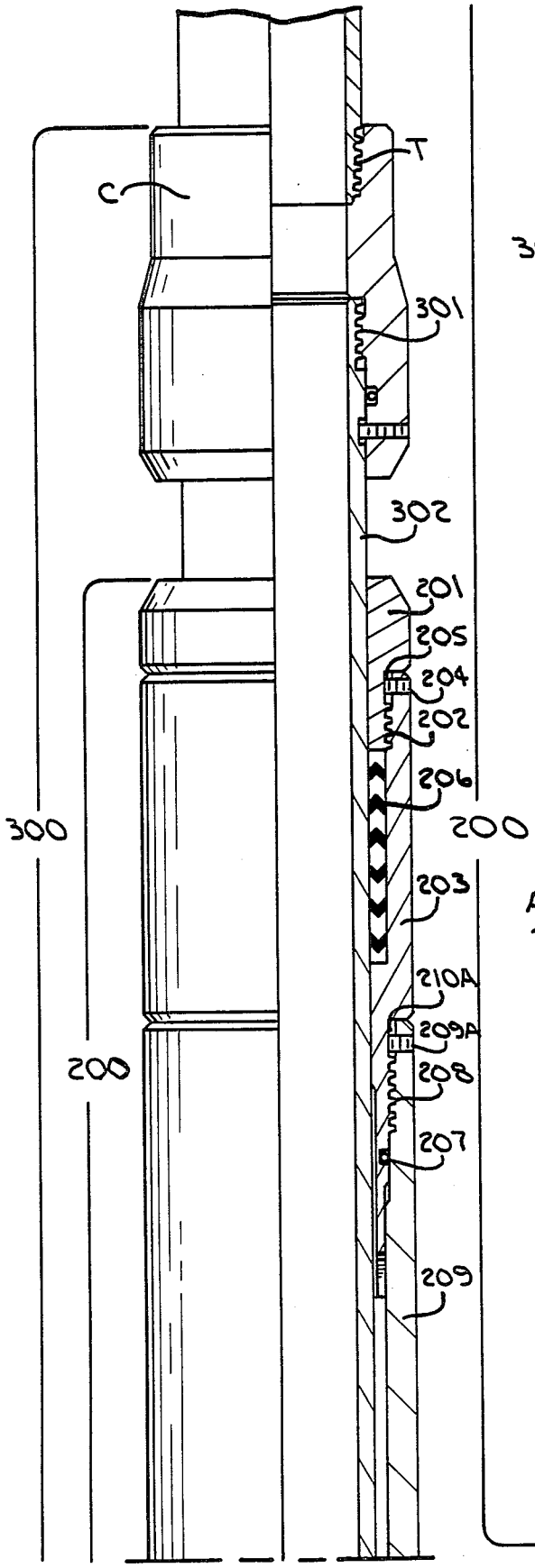
FIGS. 1A and 1B together constitute a longitudinally extending sectional view of the apparatus of the present invention with the bridge in place.
Figure 1B:
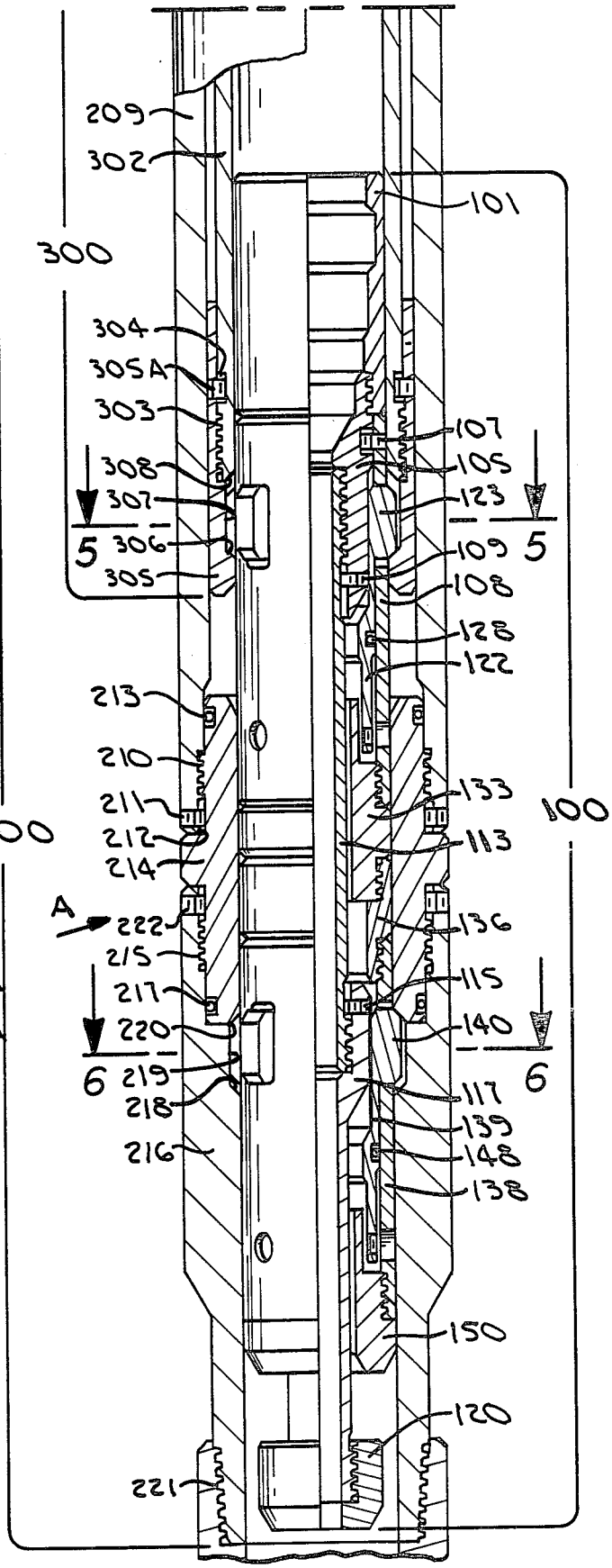

First referring to FIGS. 1A and 1B, the apparatus A, which is affixed at its uppermost end to a connector C with threads T for affixation of an upper section of tubing (not shown), generally comprises a bridge assembly 100, initially interiorly housed within the apparatus A, the bridge assembly 100 securably extending between an outer housing 200 and an inner body 300.

Figure 2:
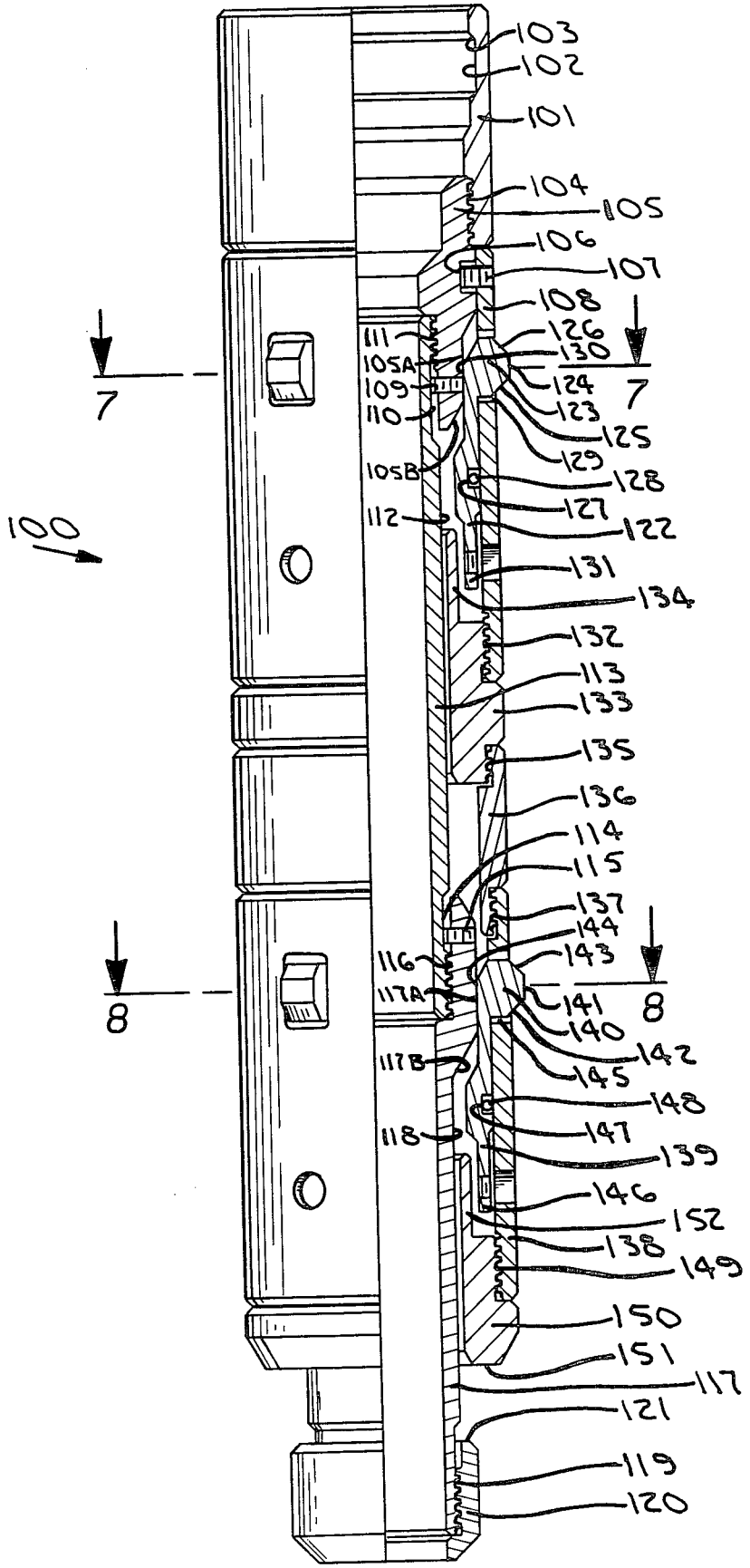
FIG. 2 is an enlarged longitudinal sectional view of the bridge component.
Figure 3A:
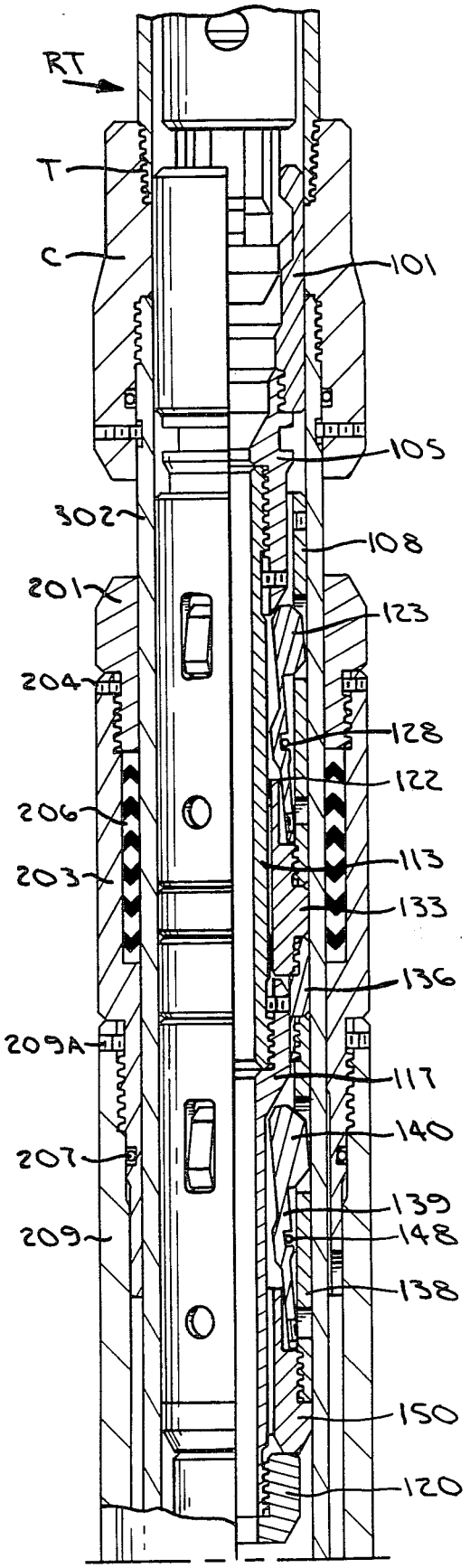
FIGS. 3A and 3B are a view similar to that of FIGS. 1A and 1B, illustrating the bridge component being shifted upwardly for removal from the outer and central housing.
Figure 3B:
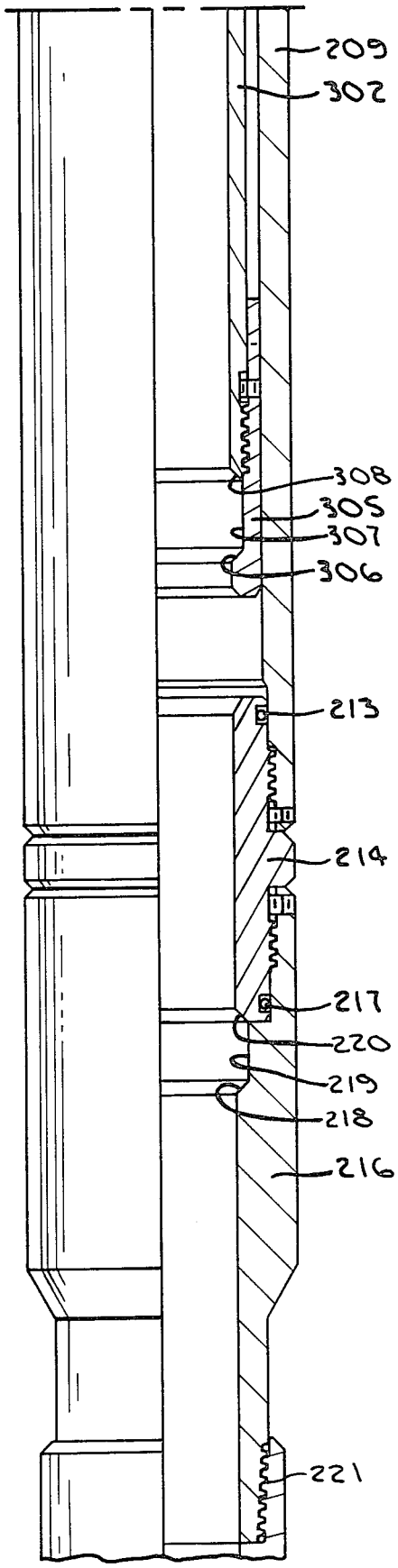
Figure 4A:
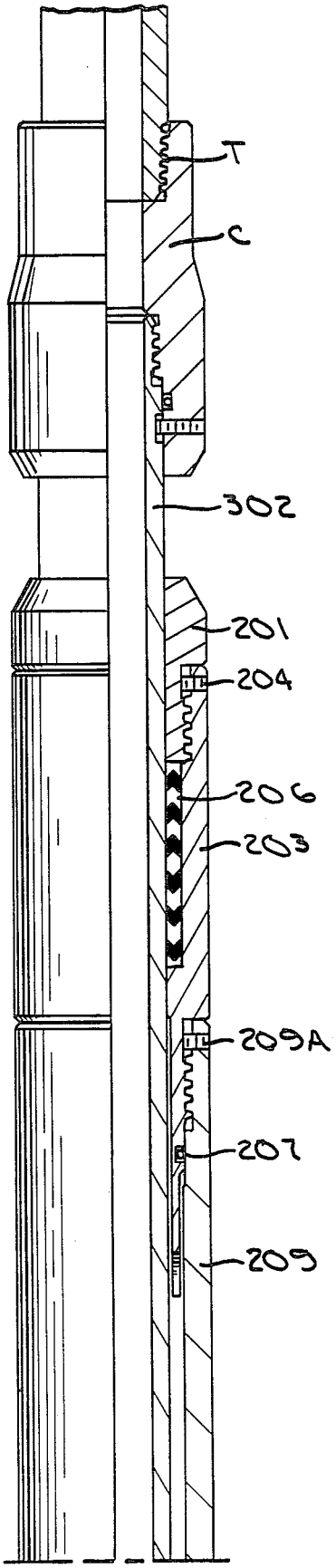
FIGS. 4A and 4B constitute a longitudinally extending sectional view, in sequence after the position shown in FIG. 3, illustrating the expansion joint after complete withdrawal of the bridge component.
Figure 4B:
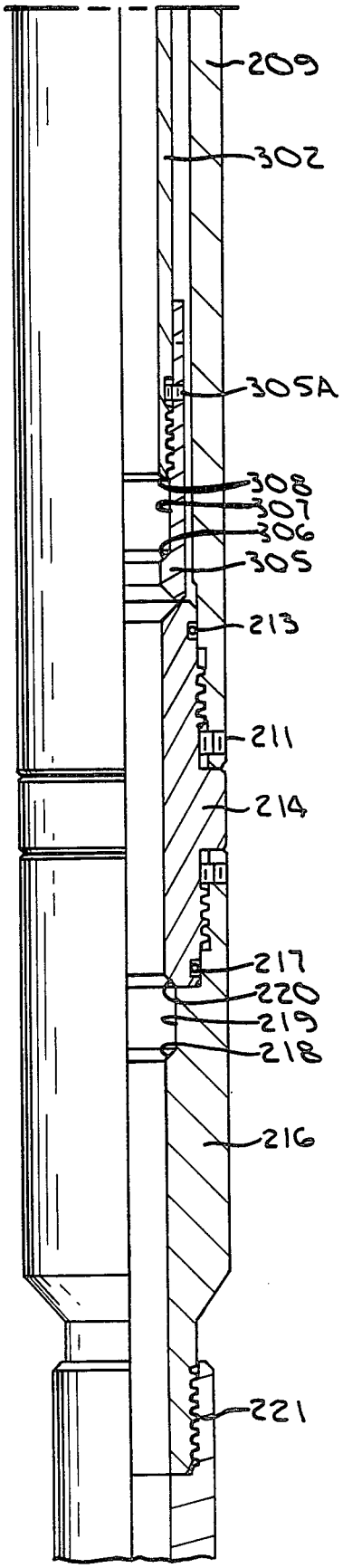
Figure 5:
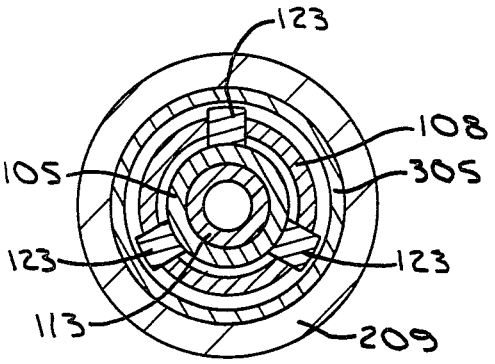
FIG. 5 is a cross sectional view taken along line 5—5 of FIG. 1B.
Figure 6:
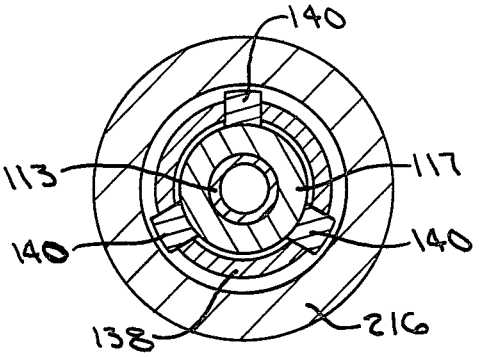
FIG. 6 is a cross sectional view taken along line 6—6 of FIG. 1B.

Now referring to FIG. 2, the bridge assembly 100 is defined at its uppermost end by a top sub member 101 having a profile 102 and a neck 103 for selective engagement of the connecting dogs of a running tool RT (FIG. 3A) for retrieval of the bridge assembly 100. The top sub 101 is affixed by threads 104 to a connector 105 extending interiorly below the top sub 101, the connector 105 having a sloped bevel 105B for contact within an interior wall 130 of a finger 123. A groove 106 exteriorly extends circumferentially around the connector 105 for receipt of a shear screw 107 therethrough. The shear screw 107 initially, but selectively, affixes the connector 105 to an upper collet housing 108 exterior thereof. The connector 105 also contains a securement screw 109 at its lowermost end affixed on to a receiving shoulder 110 of a longitudinally extending central cylinder 113 therebelow. The connector 105 also has an exterior inwardly contoured surface 105A for selective receipt of the interior wall 130 of the fingers 123.

The central cylinder 113 has immediate its lowermost end an inwardly profiled groove 114 for the resting of engagement screws 115 thereon which, together with threads 116, secure a lower body 117 to the central cylinder 113.

The lower body 117 has a beveled shoulder 117B, and the body 117 defines a circumferentially extending smooth lower collet receiving wall 118 for travel of the lower fingers 140 thereon as the bridge assembly 100 is retrieved from the interior of the apparatus A. Threads 119 secure a lower connector 120 to the lowermost end of the lower body 117. The lower connector 120 is secured to a lower length of tubing (not shown) extending within the well. The lower connector 120 has an upwardly facing circumferentially extending shoulder 121 for contact and engagement of the lower end 151 of the lower sub 150 when the bridge assembly 100 is initially shifted to disengaging position to remove the engagement of the fingers 123–140 from bridging position relative to the outer housing 200 and the inner body 300.

Figure 7:
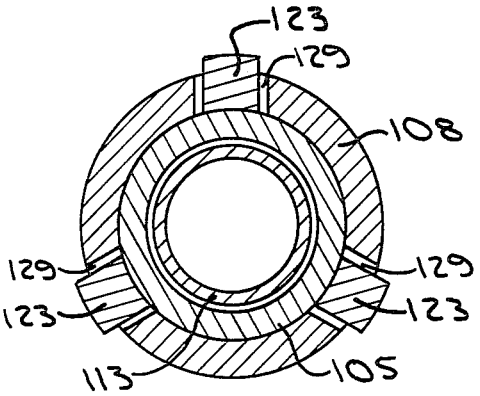
FIG. 7 is a cross sectional view taken along line 7—7 of FIG. 2.
Figure 8:
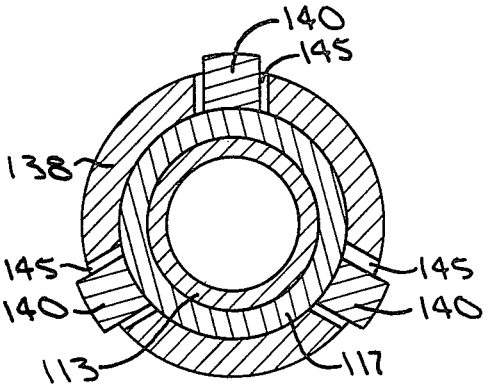
FIG. 8 is a cross sectional view taken along line 8—8 of FIG. 2.

The upper collet housing 108 carries a collet member 122 having outwardly extending finger elements 123 exteriorly protruding through the housing 108 through a collet window 129 (FIG. 7) bored therethrough. Each finger 123 has an outwardly and circumferentially extending outer wall 124 initially engaged in the central profile 307 of the inner body 300. A lower shoulder 125 is beveled on the fingers 123 and carried around the exterior of the finger 123 lowerly of the wall 124 for initial securement relative to the lower receiving shoulder 306 of the inner body 300. The fingers 123 also have defined thereon an upwardly beveled circumferentially extending upper shoulder member 126 which is initially but selectively interfacable upon a companionly contoured upper receiving shoulder 308 of the inner body 300. A spring 128 is held within a groove 127 of each of the fingers 123, the spring 128 having an exterior end resting upon the interior wall of the collet housing 108 for urging the fingers 123 into interiorly contracted position.

Each finger 123 has an interior wall 130 which initially is interfaced with the exterior surface 105A of the connector 105, but, subsequent to disengagement from the outer and central housing 200–300 of the apparatus A, will rest upon the upper collet receiving wall 112 and will be urged toward the wall 112 by the spring 128.

Each collet assembly 122 has a lower section 131 which is housed between the collet housing 108 on its exterior side and within an upwardly extending extension 134 on its interior side, the extension 134 being part of a connector 133. Threads 132 affix the connector 133 and the upper collet housing 108. The connector 133 is affixed at its lowermost end by means of threads 135 to a longitudinally extending cylindrical body member 136 which, in turn, is secured by threads 137 to a lower collet housing member 138 therebelow. The lower collet housing 138 houses a series of circumferentially extending, spaced apart collet elements 139, each collet having an exteriorly protruding finger 140 initially housed within a window 145 in the lower collet housing 138.

Each finger element has an outer wall 141 which is initially interaligned with a central profile 219 of the outer housing 200. Each finger 140 also has a lowerly beveled shoulder element 142 which is companionly received on a lower receiving shoulder 218 of the outer housing 200. An upwardly beveled circumferentially extending upper shoulder 143 is defined on each finger 140 for companion interengagement with the upper receiving shoulder 220 of the outer housing 200. An interior wall 144 extends interiorly on each of the fingers 140 and is initially interfaced with an exterior upper surface 117A of the lower body 117. The interior wall 144 of the fingers 140 interfaces with the lower collet receiving wall 118 as the bridge assembly 100 is retrieved from the outer and central housings 200–300.

Each collet 139, which is of the same design and configuration as the collets 122 thereabove, has a lower extending collet section 146 which is housed interiorly of the lower collet housing 138 and which is housed exteriorly of an upwardly extending extension 152 of a lower sub 150 secured by threads 149 to the lowermost end of the lower collet housing 138. The lower sub 150 has a lower shoulder or face 151 for selective interface with the shoulder 121 of the lower connector 120 as the bridge assembly 100 is shifted upwardly within the outer and central housings 200–300 for retrieval of the bridge assembly 100 of the apparatus A.

Now referring particularly to FIGS. 1A and 1B, the outer housing 200 is defined at its uppermost end by an upper connector 201, the connector 201 being secured by means of threads 202 to a seal housing 203 longitudinally extending therebelow. Screws 204 are received within a bore 205 defined exteriorly around the upper connector 201 for additional securement between the connector 201 and the seal housing 203. The seal housing 203 houses a series of spaced chevron-shaped seal elements 206 to prevent fluid communication between the outer housing 200 and the central housing 300, as the elements 200–300 telescope during expansion and contraction of the apparatus A subsequent to retrieval of the bridge assembly 100. An O-ring 207 is carried exteriorly on the seal housing 203 to prevent fluid communication between the housing 203 and a cylindrical housing 209 longitudinally extending below the seal housing 203 and secured thereto by means of threads 208. The cylindrical housing 209 also is secured to the seal housing 203 by means of a screw 209A extending within a bore 210A of the housing 203. The housing 209 is secured at its lowermost end by means of threads 210 to a lower connector element 214 therebelow. Additionally, the parts 209–214 are secured one to another by means of a screw 211 extending within a bore 212 of the housing 209. An elastomeric O-ring seal element 213 is carried on the uppermost end of the connector 214 for interface with the interior of the cylindrical housing 209 to prevent fluid communication between the housing 209 and the connector 214. The connector 214 is secured at threads 215 to a lower body 216 which, in turn, is secured to a lower section of tubing. An elastomeric O-ring seal element 217 is carried on the connector 214 to prevent fluid communication between the connector 214 and the lower body 216. A lower receiving shoulder 218 is lowerly and interiorly beveled on the lower body 216 for interface with the lower shoulder 142 of the lower fingers 140. A central profile 219 also is defined on the lower body 216 for initial selective receipt of the outer wall 141 of the lower fingers 140 as they are secured within the lower body 216. Finally, each of the upper shoulders 143 of the collet 139 is received within the lower body 216 at the upper receiving shoulder 220. Interface of the fingers 140 upon the shoulders 220 will prevent upward movement of the bridge assembly 100 and, in turn, the inner body 300, while lower travel of the bridge assembly 100 and the inner body 300 relative to the outer housing 200 is prevented by interface of the lower receiving shoulder 218 of the lower body 216 and the lower shoulder 142 of the fingers 140.

The inner body 300 is affixed by means of threads 301 to a connector or crossover element C having threads T thereon, at its uppermost end. The connector C is secured by the threads 301 to an extending joint 302 which interfaces on its exterior longitudinally extending outer wall with the chevron seal members 206 as the inner body 300 and the outer housing 200 telescope relative to one another. The extending joint 302 is secured at threads 303 to a lower collet receptacle 305. Additionally, the receptacle 305 is secured to the joint 302 by means of a screw 305A secured into the receptacle 305 and extending within a groove 304 of the extending joint 302. The collet receptacle 305 defines a lowerly beveled interiorly extending lower receiving shoulder 306 for interface with the lower shoulder 125 of the upper fingers 123. The collet receptacle 305 also defines a central profile 307 circumferentially extending therearound for companion receipt of the outer wall 124 of the upper fingers 123 when the bridge assembly 100 is secured relative to the inner body 300. Also, the collet receptacle 305 has an upper receiving shoulder 308 thereon for companion interface with an upper shoulder 126 on each of the upper collet fingers 123.

OPERATION

The apparatus A is run into the well on a tubing string with the bridge assembly 100 interengaging the outer housing 200 and the inner body 300 so that the housing and body 200–300 may not telescope relative to one another, this position being as shown in FIGS. 1A and 1B. Since the fingers 123–140 are locked relative to the outer housing and inner body 200–300, tubing weight is carried from the outer housing 200 to the bridge assembly 100 then to the inner body 300 to the uppermost section of tubing, to the top of the well. The housing 200 and the body 300 are locked relative to one another and cannot telescope.

When it is desired to remove the bridge assembly 100 from locked position relative to the outer housing 200 and inner body 300, to enable the housing and body 200–300 to telescope to an expanded or contracted position, a conventional running tool RT is run on wireline within the tubing string and affixed to the neck 103 of the profile 102. Thereafter, the wireline is pulled upwardly such that the upper shoulders 126–143 of the fingers 123–140 are respectively urged against the upper receiving shoulders 308–220 of the outer housing and inner body 200–300. Now, because of the inner engagement of the fingers 123–140 to the outer housing 200 and inner body 300, continued upward longitudinal pulling upon the wireline will transmit the load thereof to the shear screw 107, causing it to shear and permitting the connector 105 and its inner related parts to be disengaged from the collet housing 108 and its inner related parts. Now, the upward urging upon the top sub 101 will only be transmitted to the connector 105 and its inner related parts, and not to the collet housing 108. Therefore, the fingers 123–140 will remain in longitudinally stabilized position relative to the central cylinder 113 and connector 105 as the top sub 101, connector 105, central cylinder 113 and the lower connector 120 continue to be moved upwardly.

As the shoulder 105B of the connector 105 and the beveled shoulder 117B of the lower body 117 pass slightly above the fingers 123–140, the fingers 123–140 will begin to be urged toward the upper collet receiving wall 112 and the lower collet receiving wall 118, respectively, by means of the exertion applied to the collets 122–139 by the springs 128–148. The fingers 123 and 140 are completely urged out of their respective profiles 307–219 in the inner body 300 and the outer housing 200 as the shoulder 121 of the lower connector 120 engages the lower end 151 of the lower sub 150. Now, the upward pulling force defined through the wireline is carried through the connector 105, to the cylinder 113, thence to the upper connector 120, and to the lower sub 150 by means of the inner face of the lower end 151 and the shoulder 121, thence to the cylindrical body member 136 and its inner related parts such that the fingers 123 and 140 are shifted out of engagement within the outer housing 200 and inner body 300. Because the extending joint 302 has an interior smooth wall, continued further upward longitudinal movement of the wireline with the bridge assembly 100 will not be interfered with by the fingers 123–140, which are additionally urged towards the interiorly contracted position by the force defined through the springs 128–148.

Subsequent to retrieval of the bridge assembly 100 to the top of the well, the outer housing 100 may be selectively and automatically telescoped, expandably or contractably, relative to the inner body 300.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A selectively telescopable joint carryable on a tubular conduit having upper and lower conduit members extendable within a subterranean well, said joint comprising: an outer cylindrical housing; an inner cylindrical body carried interior of said outer cylindrical housing, one of said housing and said body connectable to said upper member and the other of said housing and said body being connectable to said lower member; seal means on one of said housing and said body and slidable along the other of said housing and body to prevent fluid communication therebetween during telescoping movement; engagement profiles defined on each of said housing and said body; a bridging member extendable within said joint and between said housing and said body; engaging means on said bridging member extendably and selectively secured within said profiles, whereby said housing and said body are in relative locked position; and means for urging and removing said engaging means out of said engagement profiles whereby said housing and said body may be selectively telescoped in expanding and contracting directions.

2. The apparatus of claim 1 wherein said housing is connectable to said upper member and said body is connectable to said lower member.

3. The apparatus of claim 1 or claim 2 wherein said seal means is on said housing and is slidable along said body.

4. The apparatus of claim 1 or claim 2 wherein said engaging means comprises first and second collet elements having a plurality of fingers circumferentially and respectively extending therearound.

5. The apparatus of claim 1 or claim 2, wherein said means for urging and removing said engaging means out of said engagement profiles comprises spring means between said engaging means and said bridging member urging said engaging means away from said engagement profiles.

6. In a selectively telescopable joint carrayable on a tubular conduit having upper and lower conduit members extendable within a subterranean well, said joint comprising: an outer cylindrical housing; an inner cylindrical body carried interior of said outer cylindrical housing, one of said housing and said body connectable to said upper member and the other of said housing and said body being connectable to said lower member; seal means on one of said housing and said body and slidable along the other of said housing and said body, to prevent fluid communication therebetween during telescopic movement; engagement profiles defined on each of said housing and said body, the improvement comprising: a bridging member extendable within said joint and between said housing and said body; engaging means on said bridging member extendably and selectively secured within said profiles, whereby said housing and said body are in relative locked position; and means for urging and removing said engaging means out of said engagement profiles whereby said housing and said body may be selectively telescoped in expanding and contracting directions.

7. The apparatus of claim 6, wherein said means for urging and removing said engaging means out of said engagement profiles comprises spring means between said engaging means and said bridging member urging said engaging means away from said engagement profiles.

* * * * *